US012092412B1

(12) United States Patent
Weimer

(10) Patent No.: US 12,092,412 B1
(45) Date of Patent: Sep. 17, 2024

(54) RIFLE ACCESSORY

(71) Applicant: Jacob Weimer, Virginia Beach, VA (US)

(72) Inventor: Jacob Weimer, Virginia Beach, VA (US)

( * ) Notice: Subject to any disclaimer, the term of this patent is extended or adjusted under 35 U.S.C. 154(b) by 91 days.

(21) Appl. No.: 18/176,577

(22) Filed: Mar. 1, 2023

(51) Int. Cl.
*F41A 21/44* (2006.01)

(52) U.S. Cl.
CPC ..... *F41A 21/44* (2013.01)

(58) Field of Classification Search
CPC ..... F41A 21/44
USPC ..... 42/90
See application file for complete search history.

(56) References Cited

U.S. PATENT DOCUMENTS

2003/0005614 A1* 1/2003 Cossio ..... F41A 35/04 42/96
2021/0404761 A1* 12/2021 Le Sage ..... F41A 21/44

* cited by examiner

*Primary Examiner* — Samir Abdosh
(74) *Attorney, Agent, or Firm* — David E. Novak; Brannon Sowers & Cracraft PC

(57) ABSTRACT

A flexible cylindrical fabric rifle cover for mitigating heat mirage, including an inner textile tube having a major axis, an outer textile tube positioned around the inner textile tube and sharing the major axis, and a plurality of middle textile tubes sandwiched between the inner and outer tubes and sharing the major axis. A plurality of thread guides are connected to the outer tube. A poly-para-phenylene terephthalamide thread runs through the thread guides and has a first end connected to the outer tube and a second end connected to a rotary reel affixed to the outer tube. The outer tube is an aramid ripstop fabric, the inner tube is an amorphous silica cloth, and the respective middle tubes are selected from the group consisting of aluminized silica fabric, basalt fiber fabric, silicone coated aluminized fiberglass fabric, poly-para-phenylene terephthalamide fabric, and aramid ripstop fabric. The rotary reel may be wound/unwound to wind/unwind the poly-para-phenylene terephthalamide thread yielding an effectively shortened/lengthened thread. The inner, middle, and outer tubes define a multilayer cloth assembly that is rolled around the major axis to define a cylinder.

9 Claims, 3 Drawing Sheets

RIFLE ACCESSORY

TECHNICAL FIELD

This novel technology relates generally to the field of firearms, and, more particularly, to cover for suppressing the heat signature from a rifle barrel.

BACKGROUND

Rifles are very accurate weapons, and in the hands of a good marksman rifles can be very effective. However, after only a few shots, the barrel may become sufficiently warm so as to heat the air around it enough to generate a mirage above the barrel. This happens when the barrel generates friction heat from shooting, heats the surrounding air to cause a density gradient, and the air density gradient gives rise to a heat mirage that is unfortunately positioned in front of the rifle scope's front lens, interfering with the shooter's ability to clearly see the target.

Barrel mirage has been addressed by such accessories as aluminum barrel shades, which attach to the barrel to guide the hot air around the barrel and away from the scope, and composite material ribbed solid cylindrical sleeves, which slide over the barrel to assist in radiating heat away from the barrel. While helpful, the relatively inexpensive barrel shade is a good heat conductor and quickly becomes uncomfortably hot to the touch while likewise interfering with the balance of the rifle. The cylindrical sleeve provides a better balance to the rifle, but is significantly more expensive, is sized to snugly fit a single barrel diameter, and is time consuming in attaching to and detaching from the barrel. Thus, there remains a need for an improved barrel heat mirage mitigation device. The present novel technology addresses this need.

DETAILED DESCRIPTION

Figure 1:
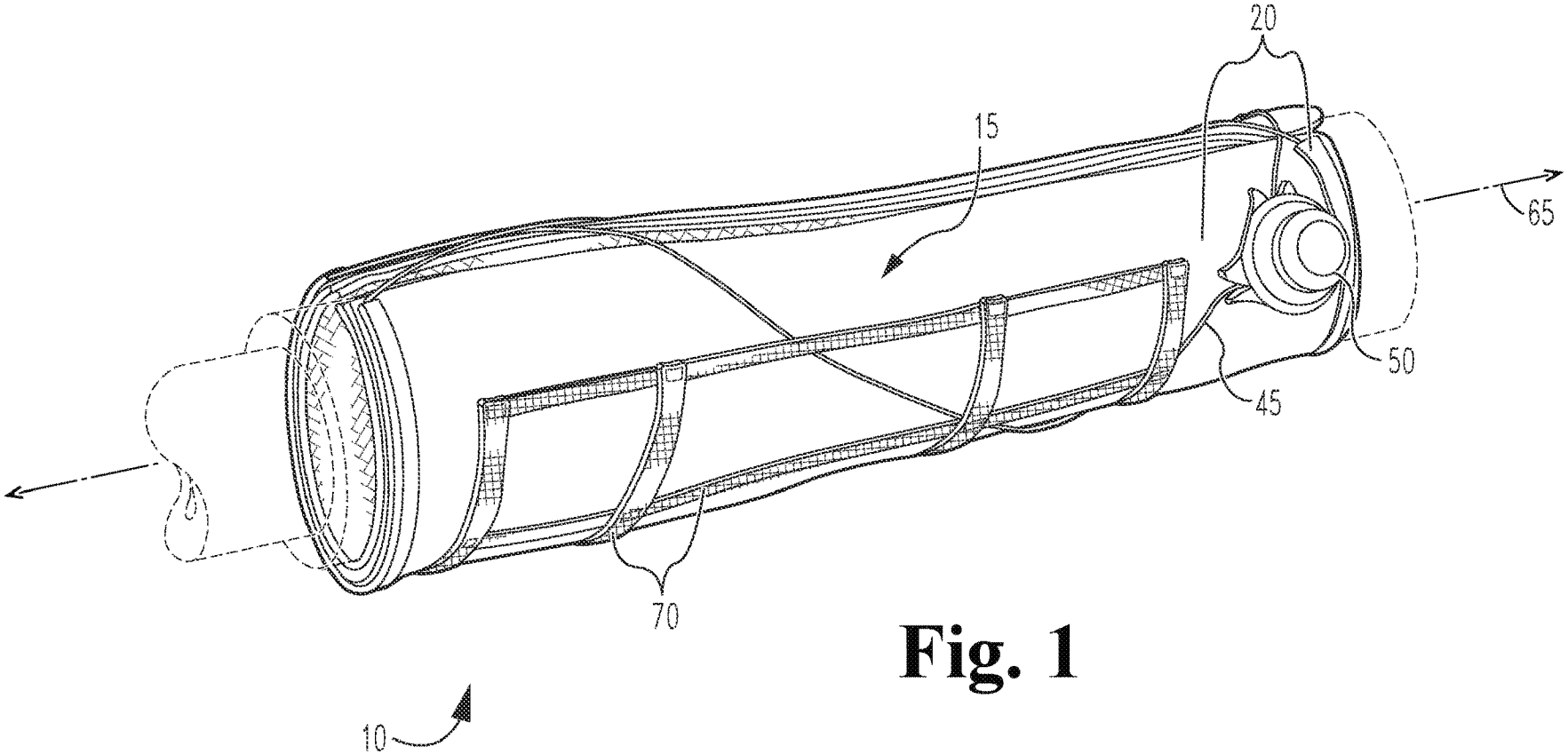
FIG. 1 is a first perspective view illustration of flexible heat mirage mitigation device according to a first embodiment of the present novel technology.

For the purposes of promoting an understanding of the principles of the novel technology, reference will now be made to the embodiments illustrated in the drawings and specific language will be used to describe the same. It will nevertheless be understood that no limitation of the scope of the novel technology is thereby intended, such alterations and further modifications in the illustrated device, and such further applications of the principles of the novel technology as illustrated therein being contemplated as would normally occur to one skilled in the art to which the novel technology relates.

Figure 3:
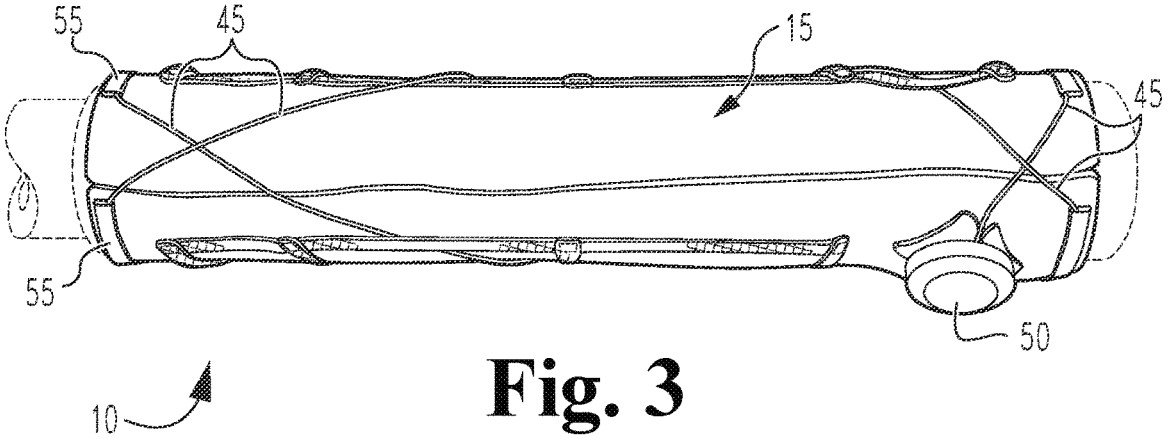
FIG. 3 is a second side elevation view of the embodiment of FIG. 1.
Figure 2:
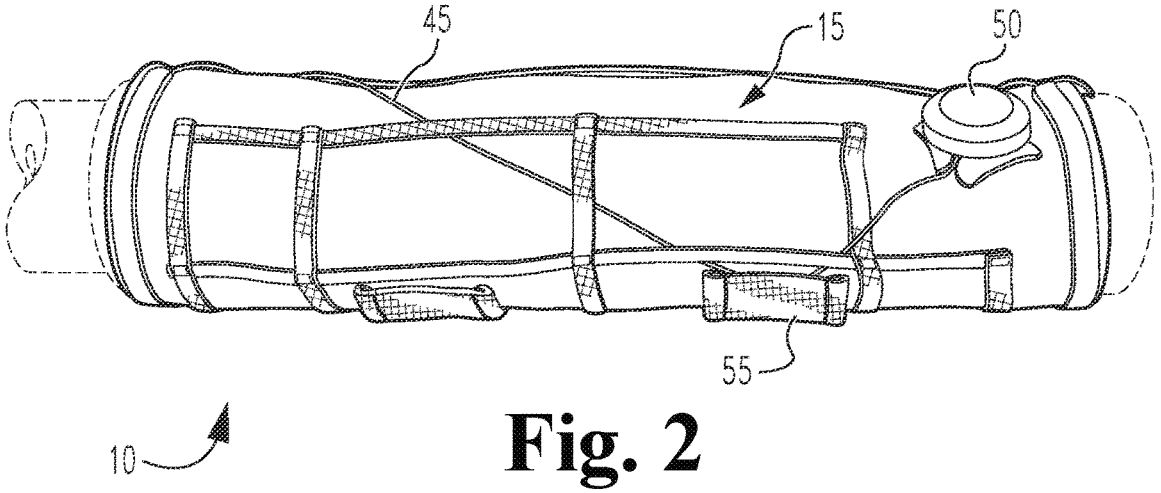
FIG. 2 is a first side elevation view of the embodiment of FIG. 1.
Figure 4:
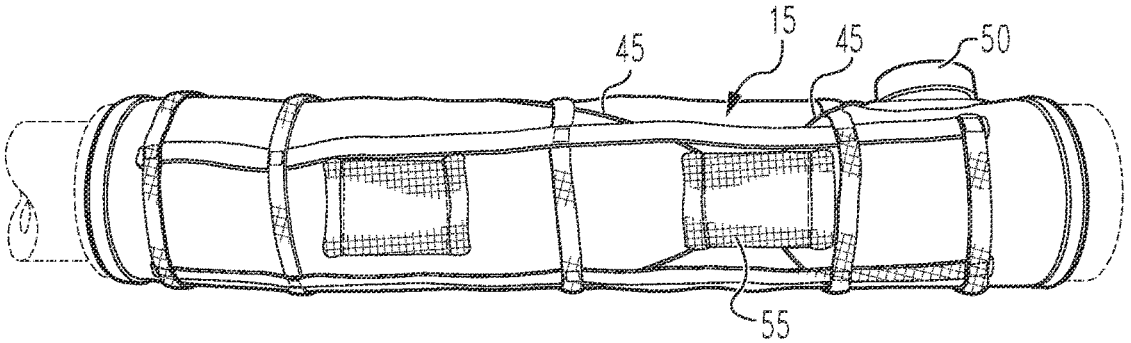
FIG. 4 is a third side elevation view of the embodiment of FIG. 1.
Figure 5:
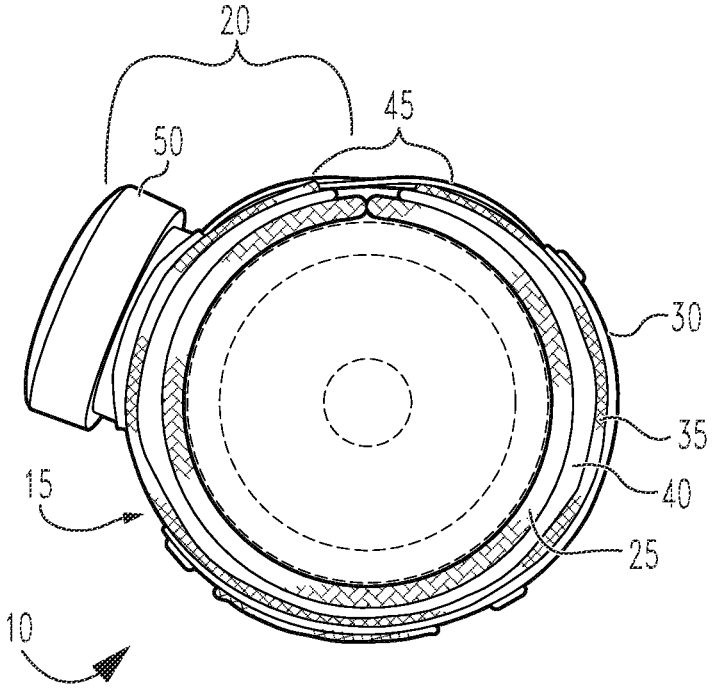
FIG. 5 is a first front elevation view of the embodiment of FIG. 1.

FIGS. 1-5 illustrate a first embodiment of the present novel technology, a flexible, multilayered heat mitigating barrel sleeve 10 that may be tightened and loosened to fit any barrel dimension. As used broadly herein, 'barrel' may refer to a rifle barrel alone or to one that is equipped with a suppressor, wherein the sleeve 10 would then fit over the suppressor as well as the underlying rifle barrel. The barrel sleeve 10 includes a multilayers generally cylindrically 15 oriented fabric portion 15 and an operationally connected tightening assembly portion 20 for sizing the sleeve onto a rifle barrel.

The fabric portion 15 includes an inner layer 25, an outer layer 30, and at least one, and more typically at least two, middle layers 35, 40 positioned therebetween. The layers 25, 30, 35, 40 may be sewn together, held together by adhesives, held together with clips, and/or by any like convenient connection means and/or combinations thereof. The inner layer 25 is defined as the gun adjacent or barrel contacting layer when the sleeve 10 is wrapped in a generally cylindrical configuration for engagement and/or cooperation with a rifle barrel, while the outer layer 30 is disposed opposite the inner layer 25 and is farthest from the barrel. All layers 25, 30, 35, 40, and any connection means, are typically formed from high temperature cloth/textile and/or adhesive materials that also exhibit high thermal resistance, strength, and toughness.

For instance, the inner layer 25 is typically made of a heat resistant material, such as an amorphous silica fiber textile like SILTEX. SILTEX is a fabric made of amorphous silica fibers woven to define a strong, flexible, heat resistant textile. The inner layer 25 offers thermal protection as well as thermal insulation. SILTEX is a registered trademark of Mid-Mountain Materials, Inc. CORPORATION WASHINGTON 5602 Second Avenue South Seattle WASHINGTON 98108, reg. no. 4716368, reg. date Apr. 7, 2015.

The outer layer 30 is typically formed from an aramid fabric, more typically a ripstop fabric, such as NOMEX. NOMEX is a registered trademark of the E. I. du Pont de Nemours and Company CORPORATION DELAWARE 1007 Marchket Street Wilmington DELAWARE 19898, reg. no. 1706847, reg. dater Aug. 11, 1992. NOMEX, and like aramid polymers are similar in structure to nylon, but instead feature aromatic backbones, making them more rigid as well as more durable. NOMEX is a meta variant aramid, having unaligned strands yielding moderate tensile strength in the resultant textile but excellent thermal, chemical, and radiation resistance for a polymer material. It can withstand temperatures of up to 370° C. Of particular usefulness as an outer layer 30 is NOMEX Essential Ripstop 600, a high-strength ripstop fabric having a reinforced weave pattern offering great resistance to tearing and ripping.

Middle layers 35, 40 are typically heat reflective for containing the thermal energy generated by firing the rifle. For example, one middle layer 35, 40 may be made of aluminized silica fabric, such as AMI-SIL. AMI-SIL is a registered trademark of the Auburn Manufacturing, Inc. CORPORATION MAINE P.O. Box 220 Mechanic Falls MAINE 04256, reg. no. 1736559, reg. date Dec. 1, 1992. AMI-SIL is an extremely high heat resistant fabric made from at least 96% amorphous silica fibers with an aluminized or otherwise metalized polyester film laminated to one side. Aluminized AMI-SIL fabrics are effective against extreme radiant heat. This layer 35, 40 is typically oriented with the aluminized or metallized side facing the inner layer 25 and/or rifle barrel so as to confine heat therein and retard heat transfer to the outer layer 30 and thus into the surrounding air.

Another typical choice for a middle layer 35, 40 is silicone coated aluminized fiberglass fabric, as this material is likewise a high temperature, heat resistant aluminum film and silicone rubber dual-coat fabric that reflects radiant heat and also minimizes absorption of fluids and contamination. Silicone coated aluminized fiberglass fabric is similarly heat reflective, reflecting 95% or more of the radiant heat that contacts its aluminized surface (which is likewise oriented to reflect heat back to the barrel).

Still another typical material for an inner layer 35, 40 is basalt fiber cloth. Basalt fiber cloth is similar to carbon fiber cloth and/or fiberglass, but basalt fabric has more suitable mechanical properties (strength, toughness, shock resistance) than fiberglass and is more heat resistant and less expensive carbon fiber cloth. Basalt fiber cloth is made from extremely fine fibers of basalt, which is composed of the minerals plagioclase, pyroxene, and olivine. Basalt fiber cloth can withstand temperatures up to 980° C. and is commonly used as a fireproof textile.

Yet another textile suitable for one of the middle layers 35, 40 is KEVLAR (KEVLAR is a registered trademark of the E. I. du Pont de Nemours and Company CORPORATION DELAWARE 1007 Marchket Street Trademarks & Copyright Group Wilmington DELAWARE 19898, reg. no. 2121970, reg. date Dec. 16, 1997).

KEVLAR, or poly-para-phenylene terephthalamide, is a manufactured polymer made from a chemical reaction between an acid and a chemical solution containing nitrogen and hydrogen. Spun KEVLAR fiber has a tensile strength of 3,620 MPa arising from its plurality of inter-chain bonds and aromatic stacking interactions between carbonyl groups and NH centers as well as between adjacent strands.

The tightening assembly 20 further includes a Kevlar or like elongated flexible thread or wire member 45 wrapped around and operationally connected to the sleeve portion 15. A thread length management device 50, such as a click dial, reel, or like, is operationally connected to the sleeve portion 15 as well as operationally connected to the thread member 45, wherein turning the click dial 50 in a first direction spools the thread member 45 thereupon and turning the click dial 50 in a second, opposite direction unspools the thread member 45 therefrom. The thread member 45 is operationally connected to one, and typically a plurality of, thread guides 55 sewn or otherwise affixed to the multilayer cloth assembly 15 so as to guide the thread member 45 around the barrel sleeve 10. One end of the thread member is fixedly connected to the click dial 50 at or near one end of the sleeve 10 while the other end of the thread member 45 is fixedly connected to the sleeve 10, and is typically, although not necessarily, disposed opposite the click dial as taken along the major axis 65 of the sleeve 10.

In some embodiments, the exterior of the sleeve 10 also includes flexible fabric grip members 70 sown or otherwise affixed thereto. The grip members 70 are likewise made from high temperature, high strength materials as described above for the other layers, such as NOMEX ripstop fabric or the like.

In some embodiments, one or more clip members 80 is affixed to the multilayer cloth assembly 15 to both help hold the layers 25, 30, 35, 40 together and also to maintain the cylindrical orientation of the sleeve 10.

While the novel technology has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make a nigh-infinite number of insubstantial changes and modifications to the above-described embodiments and that it would be impractical to attempt to describe all such embodiment variations in the present specification. Accordingly, it is understood that all changes and modifications that come within the spirit of the novel technology are desired to be protected.

I claim:

1. A flexible fabric rifle cover for reducing heat mirage, comprising:

an inner textile layer;

an outer textile layer;

at least one middle textile layer positioned between and operationally connected to the inner and outer layers;

a plurality of thread guides operationally connected to the outer layer;

a thread running through the thread guides and having a first end connected to the outer layer and a second end; and a thread length management device operationally connected to the second end;

wherein the thread length management device may be actuated to wind the thread yielding an effectively shortened thread;

wherein the thread length management device may be actuated to unwind the thread yielding an effectively lengthened thread;

wherein the inner, at least one middle, and outer layers define a multilayer cloth assembly; and wherein the multilayer cloth assembly is rolled around a major axis to define a cylinder.

2. The flexible fabric rifle cover for reducing heat mirage of claim 1 wherein the inner layer is amorphous silica cloth and wherein the outer layer is aramid ripstop fabric.

3. The flexible fabric rifle cover for reducing heat mirage of claim 1 wherein the at least one middle layer is two respective middle layers.

4. The flexible fabric rifle cover for reducing heat mirage of claim 3 wherein the at least one middle layer is a first middle layer of aluminized silica fabric and is a second middle layer of basalt fiber fabric.

5. The flexible fabric rifle cover for reducing heat mirage of claim 1 wherein the at least one middle layer is three respective middle layers.

6. The flexible fabric rifle cover for reducing heat mirage of claim 5 wherein the at least one middle layer is a first middle layer of aluminized silica fabric and is a second middle layer of basalt fiber fabric and is a third middle layer of silicone coated aluminized fiberglass fabric.

7. The flexible fabric rifle cover for reducing heat mirage of claim 5 wherein the at least one middle layer is a first middle layer of aluminized silica fabric and is a second middle layer of basalt fiber fabric and is a third middle layer of poly-para-phenylene terephthalamide fabric.

8. The flexible fabric rifle cover for reducing heat mirage of claim 1 wherein the thread length management device is a twist dial.

9. A flexible cylindrical fabric rifle cover for mitigating heat mirage, comprising:

an inner textile tube having a major axis;

an outer textile tube positioned around the inner textile tube and sharing the major axis;

a plurality of middle textile tubes sandwiched between the inner and outer textile tubes and sharing the major axis;

a plurality of thread guides operationally connected to the outer textile tube;

a poly-para-phenylene terephthalamide thread running through the thread guides and having a first end connected to the outer textile tube and a second end; and a rotary reel affixed to the outer textile tube and operationally connected to the second end;

wherein the outer textile tube is an aramid ripstop fabric;

wherein the inner textile tube is an amorphous silica cloth;

wherein the respective middle textile tubes are selected from the group consisting of aluminized silica fabric, basalt fiber fabric, silicone coated aluminized fiberglass fabric, poly-para-phenylene terephthalamide fabric, and aramid ripstop fabric;

wherein the rotary reel may be wound to wind the poly-para-phenylene terephthalamide thread yielding an effectively shortened thread;

wherein the rotary reel may be unwound to unwind the poly-para-phenylene terephthalamide thread yielding an effectively lengthened thread;

wherein the inner, middle, and outer textile tubes define a multilayer cloth assembly; and wherein the multilayer cloth assembly is rolled around the major axis to define a cylinder.

* * * * *